US005359826A

United States Patent [19]

Grearson

[11] Patent Number: 5,359,826

[45] Date of Patent: Nov. 1, 1994

[54] STRUCTURAL FRAMING MEMBER AND PREFABRICATED PANEL STRUCTURE

[75] Inventor: Kenneth R. Grearson, Park Ridge, Ill.

[73] Assignee: Multuloc International Systems Corporation, Chicago, Ill.

[21] Appl. No.: 966,756

[22] Filed: Oct. 26, 1992

[51] Int. Cl.[5] ..... E04C 3/00; F16B 7/02

[52] U.S. Cl. ..... 52/650.1; 52/726.1; 403/363

[58] Field of Search ..... 52/738, 731.7, 762, 52/241, 463, 726.1, 710, 730.3, 582.1, 650.1; 403/21, 300, 312, 348, 363

[56] References Cited

U.S. PATENT DOCUMENTS

| | | | |
|---|---|---|---|
| 2,211,384 | 8/1940 | Patterson | 52/731.7 |
| 2,627,632 | 2/1953 | Kelly | 52/730.33 |
| 2,737,268 | 3/1956 | Smith | 403/21 |
| 2,784,812 | 3/1957 | Kindorf | 52/710 |
| 3,174,590 | 3/1965 | Haker | 52/463 |
| 3,537,217 | 11/1970 | Lickliter et al. | 52/738 |
| 3,626,650 | 12/1971 | Lickliter et al. | 52/762 |
| 3,638,387 | 2/1972 | Lickliter et al. | 52/241 |
| 3,918,230 | 11/1975 | Carroll | 52/335 |
| 3,962,841 | 6/1976 | Carroll | 52/354 |
| 3,965,633 | 6/1976 | Carroll | 52/410 |
| 3,965,641 | 6/1976 | Carroll | 52/738 |
| 4,006,731 | 2/1977 | Carroll | 52/309.8 |
| 4,048,777 | 9/1977 | Carroll | 52/309.12 |
| 4,090,336 | 5/1978 | Carroll | 52/309.7 |
| 4,114,335 | 9/1978 | Carroll | 52/336 |
| 4,120,131 | 10/1978 | Carroll | 52/310 |
| 4,267,678 | 5/1981 | Carroll | 52/338 |
| 4,274,239 | 6/1981 | Carroll | 52/443 |
| 4,394,807 | 7/1983 | Carroll | 52/332 |
| 4,507,901 | 4/1985 | Carroll | 52/309.11 |

FOREIGN PATENT DOCUMENTS

| | | | |
|---|---|---|---|
| 2268180 | 11/1975 | France | 403/363 |
| 751538 | 6/1956 | United Kingdom | 52/731.6 |
| 1473644 | 5/1977 | United Kingdom | 52/582.1 |

OTHER PUBLICATIONS

UNISTRUT® Metal Framing, General Engineering Catalog, North American Edition No. 12, Issued by Unistrut Diversified Products, 35660 Clinton Street, Wayne, Mich. 48184, 1992.

*Primary Examiner*—James L. Ridgill, Jr.
*Attorney, Agent, or Firm*—Speckman, Pauley & Fejer

[57] ABSTRACT

A structural framing member having a base and two opposing side walls projecting from the base in a direction approximately perpendicular to the base. Each side wall has an intermediate flange which is approximately parallel to the base and which divides each corresponding side wall into a lower portion and an upper portion. The lower portion is offset from the upper portion by a distance equal to the width of the intermediate flange. A distance between the lower portions of the side wall is greater than a distance between the upper portions of the side wall. Each side wall has an upper flange directed inward toward each other. Each upper flange has a terminal end portion which is angled downward toward the base and is approximately perpendicular to the upper flange. The terminal end portions are spaced apart from each other thereby defining a continuous slot along a longitudinal axis of the structural framing member. Two structural framing members are positioned on opposing sides of a panel. The panel is supported by and secured to the two opposing structural framing members to form a prefabricated panel structure.

7 Claims, 11 Drawing Sheets

STRUCTURAL FRAMING MEMBER AND PREFABRICATED PANEL STRUCTURE

BACKGROUND OF THE INVENTION

1. Field of the Invention

This invention relates to a structural framing member having a base and a side wall with an intermediate flange which is approximately perpendicular to the side wall, and a prefabricated panel structure having two structural framing members positioned on opposing sides of a panel wherein the panel is supported upon one intermediate flange of each structural framing member.

2. Description of Prior Art

U.S. Pat. No. 4,120,131 discloses a flanged box section formed by a bottom closure, two opposing bottom flanges, two opposing sides and two opposing upper flanges. The lower flanges are formed of sheet metal being doubled back on itself making the lower flanges a double thickness of the sheet metal. The '131 patent fails to teach or even suggest a side wall between the bottom closure and the lower flange of the box section, whereby a defined distance is maintained between the bottom closure and the lower flange.

U.S. Pat. No. 4,274,239 also teaches a flanged box section having flanges formed of sheet metal being doubled back on itself making the flanges a double thickness of the sheet metal. The '239 also fails to either teach or even suggest a side wall between the bottom closure and the lower flange member so that a defined distance is maintained between the lower flange and the bottom closure.

In specific applications, it is very critical to maintain a distance between such a flange surface and the base member of a flanged box section. For example, a spot weld is often used to attach a panel or other member to the flange surface. When spot welding to a flange taught by the '131 patent and/or the '239 patent, the heat generated will at least cause the bottom closure surface to experience an extreme temperature increase due to conduction and radiation heat transfer. Such high temperature of the bottom closure member can result in oxidation of the sheet metal coating and/or removal of a painted coating or the like. Such spot welding can also result in complete burning penetration of the flange and the bottom closure, particularly when the bottom closure is positioned adjacent the flange. When attaching a panel member or the like to the flange surface, various fasteners, such as a sheet metal screw, can also be used. A significant disadvantage of the teachings of the '131 and '239 patents is penetration of such fastener through the bottom closure member, leaving exposed sharp ends and thereby creating a safety hazard and an aesthetically unpleasant structure.

Continuous slot metal framing members which have an overall C-shape, with end portions of the legs of the C-shape turned inwardly toward each other and then downwardly toward the base, have been used in construction. Such continuous slot metal framing members are commercially available through Power-Strut Division, in Warren, Ohio, and GS Metals Incorporated, Pinckneyville, Ill. Such known framing members have also been used in combination with various angled brackets. Such conventional framing members have also been used in combination with nuts and bolts wherein a nut is positioned within a space or void of the channel and a bolt is positioned within the continuous slot of the channel.

In view of the conventional technology, it is apparent that there is a need for a structural framing member which can accommodate the attachment of panel structures by spot welding and/or various fasteners without altering the structural, aesthetic and protective aspects of the base member or base plate of the structural framing member. It is also apparent that there is a need for a prefabricated panel structure which can be assembled remotely from a jobsite, or within a fabrication shop where labor and assembly techniques are much more efficient than similar services related to field fabrication.

SUMMARY OF THE INVENTION

It is one object of this invention to provide a structural framing member which is roll formed from a piece of sheet metal into a base and two opposing side walls, wherein each side wall has a lower portion which is offset from an upper portion of the side wall by an intermediate flange which is approximately perpendicular to the side walls and approximately parallel to the base.

It is another object of this invention to provide a structural framing member wherein an intermediate flange is spaced at a defined distance from the base so that the intermediate flange can be spot welded and/or can accommodate a fastener without altering the structural, aesthetic or protective aspects of the base, particularly a bottom surface of the base.

It is another object of this invention to provide a structural framing member having one continuous slot framing member secured within another framing member generally having a C-shaped cross section.

It is still another object of this invention to provide a prefabricated panel structure having two structural framing members, each with an intermediate flange, wherein the structural framing members are positioned on opposing sides of a panel so that the panel is supported upon and secured to one intermediate flange surface of each structural framing member.

It is yet another object of this invention to provide a longitudinally aligned and a perpendicular connection between two structural framing members having their bases in a same general plane.

The above and other objects of this invention are accomplished with a structural framing member having a base and two opposing side walls projecting from opposing sides of the base, in a direction approximately perpendicular to the base. Each side wall preferably forms an intermediate flange which is approximately parallel to the base. Each intermediate flange divides the corresponding side wall into a lower side wall portion and an upper side wall portion which are approximately parallel to each other but offset with respect to each other by the distance or width of the intermediate flange. The intermediate flanges are preferably directed toward each other so that a normal distance between the lower side wall portions is greater than a normal distance between the upper side wall portions.

Each upper side wall portion has an upper flange directed toward an opposite upper side wall portion and the upper flange is approximately perpendicular to the side walls. Each upper flange has a terminal end portion which is angled, preferably perpendicular, with respect to the base and the upper flanges. The terminal end portions are spaced apart from each other thereby defining a continuous slot along a longitudinal axis of the structural framing member.

In another preferred embodiment according to this invention, the structural framing member includes two independent members having a generally C-shaped cross section, which are secured to each other. The first member has a base with two opposing side walls that are approximately perpendicular to the base. Such side walls are directed in a same direction away from the base and each have an end flange portion which is approximately perpendicular to the side walls. The end flange portions are directed inwardly toward each other. Each end flange portion has a terminal end portion which is directed downward toward the base. The end flange portions are spaced apart from each other thereby defining a continuous slot. The second member of such preferred embodiment has a base with two opposing side walls that are positioned at an angle with respect to the base. A bottom base surface of the first member is in planar contact with and secured to a top base surface of the second member. A panel or the like is positioned upon the side wall of the second member. An end surface of the panel can be positioned so that it either abuts or is closely adjacent to the side wall of the first member.

In such preferred embodiment according to this invention, the side wall of the second member can also have an inwardly directed flange surface which functions as an equivalent of the intermediate flange of the structural framing member previously discussed.

In still another preferred embodiment according to this invention, a panel is positioned upon either longitudinally aligned intermediate flanges of two or more parallel structural framing members or perpendicularly adjacent intermediate flanges of two or more perpendicularly positioned structural framing members. The perpendicularly positioned structural framing members can be secured with respect to each other with a splicing plate. The longitudinally aligned structural framing members can be secured with respect to each other with the splicing plate and/or a splice element.

According to yet another preferred embodiment of this invention, a prefabricated panel structure can be constructed at a remote location from a jobsite and shipped to the jobsite in a preassembled or prefabricated form. Such prefabricated panel structure includes two structural framing members each positioned on opposing sides of a panel. The panel is supported upon an intermediate flange or a side wall of a second member, so that the bottom surface of the supported portion of the panel abuts a top surface of the intermediate flange and thus is fixed at a defined distance from the base of the structural framing member. The panel is secured to the structural framing member. The continuous slot of the structural framing member accommodates the securement of a hanger structure so that the prefabricated panel can be hoisted or otherwise lifted for transport.

Once the prefabricated structure arrives at the jobsite or field location, it can be quickly transported into position. With the continuous slot arrangement, the position of the hanging structure can be adjusted and additional structural members for hanging the panel can be added at any desirable location along the continuous slot. The structural hanging members are preferably secured to the continuous slot structural framing member with angle brackets or other suitable fasteners which are apparent to those skilled in the art.

DESCRIPTION OF PREFERRED EMBODIMENTS

The structural framing members of this invention are particularly useful for constructing a prefabricated panel structure which can be assembled at a remote location, such as a shop, from the field location or the jobsite. The structural framing member according to this invention has a continuous slot along a longitudinal axis of the structural framing member. Such slot is particularly advantageous for accommodating the adjustment of structural hanging members in the field, as well as for attaching or securing other structural framing members with respect to each other and with respect to fixed structures.

Figure 1:
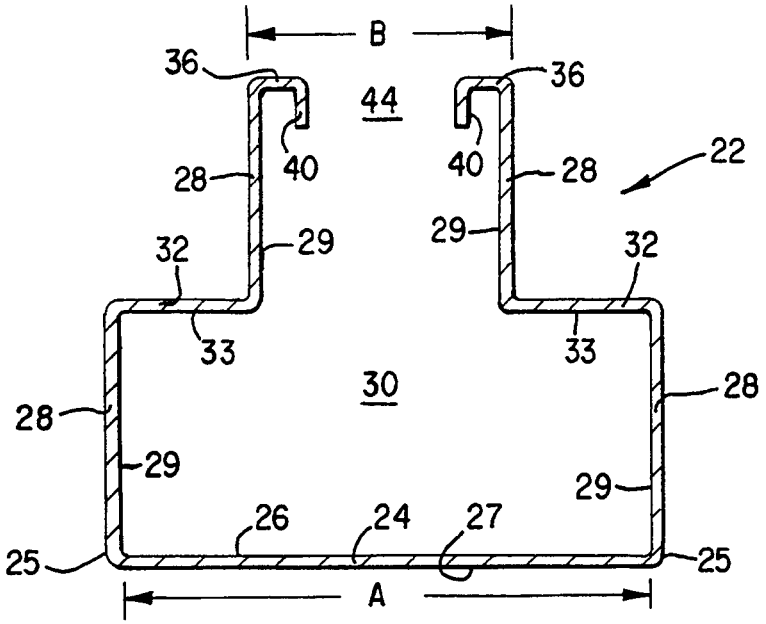
FIG. 1 is a cross-sectional view of a structural framing member, according to one preferred embodiment of this invention.

Referring to the preferred embodiment of this invention as shown in FIG. 1, elongated structural framing member 22 is shown in a cross-sectional view. As shown in FIG. 1, structural framing member 22 is roll formed from a continuous piece of material, preferably sheet metal. The sheet metal is approximately 10 gage to approximately 20 gage, preferably approximately 12 gage to approximately 14 gage. Although shown as a roll formed member in FIG. 1, it is apparent that structural framing member 22 may also comprise individual plates welded, extruded or otherwise secured to each other in any suitable manner known to those skilled in the art. It is also apparent that the length of structural framing member 22 can vary between approximately 1 foot and approximately 50 feet, but preferably varies between approximately 18 feet and approximately 22 feet. Even shorter or longer sections of structural framing member 22 can be used, depending upon the particular arrangement of a deck structure or other type of panel structure.

As shown in FIG. 1, structural framing member 22 comprises base 24 which has two opposing longitudinal sides 25. Two opposing side walls 28 are directed or project in the same direction from corresponding sides 25 of base 24. Side walls 28 are preferably positioned approximately perpendicular to base 24. Throughout the specification and in the claims, the phrase "approximately perpendicular" is intended to mean close enough to 90° to accommodate for manufacturing tolerances associated with roll forming sheet metal and/or fabricating structural plates with respect to each other. It is also apparent that the relative angles of such elements can vary; however, generally accepted building construction principles require square fittings so that assembled elements remain level or plumb.

Each side wall 28 either forms or is secured to intermediate flange 32 which is positioned approximately parallel with respect to base 24. Intermediate flange 32 divides side wall 28 into a first or lower side wall portion and a second or upper side wall portion. A plane defined by the first side wall portion is approximately parallel to a plane defined by the second side wall portion. Such parallel planes are offset by a distance equal to the width of intermediate flange 32. As shown in FIG. 1, distance A between both first or lower side wall portions is greater than distance B between the second or upper side wall portions.

The second or upper side wall portion of side wall 28 has upper flange 36 which is directed inward toward the opposite side wall 28. Upper flange 36 is positioned approximately perpendicular with respect to side wall 28. Upper flange 36 has terminal end portion 40 which is angled downward, as shown in FIG. 1, toward base 24. Terminal end portion 40 is approximately perpendicular to upper flange 36. Terminal end portions 40 of side walls 28 are spaced apart from each other and thereby define or form continuous slot 44 along a longitudinal axis of structural framing member 22. Throughout the specification and in the claims, the phrase "continuous slot" is used to refer to the opening formed between terminal end portions 40. It is apparent that the continuous slot does not necessarily have to be continuous along the entire length of structural framing member 22 but rather along at least a portion of the length of structural framing member 22. The continuous nature of slot 44 is for the purpose of accommodating field adjustments. Thus, it may be more desirable to form continuous slot 44 along as much of the length of structural framing member 22 as possible.

In one preferred embodiment according to this invention, intermediate flange 32 is spaced at a defined distance from base 24. Such defined distance is preferably equal to at least a thickness of base 24. As shown in FIG. 1, inner wall 33 of intermediate flange 32 is positioned at a distance equal to multiple thicknesses of base 24 from inner wall 26 of base 24. It is a particularly important aspect of this invention to maintain such distance. For example, when spot welding a panel or other member to intermediate flange 32, it is necessary to maintain such distance so that the physical properties and physical aspects of base 24 remain constant. If intermediate flange 32 is too close to base 24, then when spot welding a member to intermediate flange 32, too much heat transfer by conduction and/or radiation will likely occur from intermediate flange 32 to base 24. Such increased heat transfer may result in either burning a hole through base 24 or raising the temperature of base 24 high enough to oxidize bottom surface 27 and/or remove a protective coating from bottom surface 27. In many applications, bottom surface 27 is exposed to a working environment as either a portion of an inner wall or a ceiling. Thus, it is necessary to protect the physical properties and physical aspects of such member for safety reasons, for aesthetic reasons and to prolong the life of the structural member. Also, maintaining such distance is critical when using fasteners, such as screws, rivets, nails or the like, to secure a panel or other member to intermediate flange 32. Without such defined distance, the fastener can protrude through base 24 and thus project beyond bottom surface 27, which can result in an exposed sharp end which is unsafe and aesthetically unpleasant.

Figure 2:
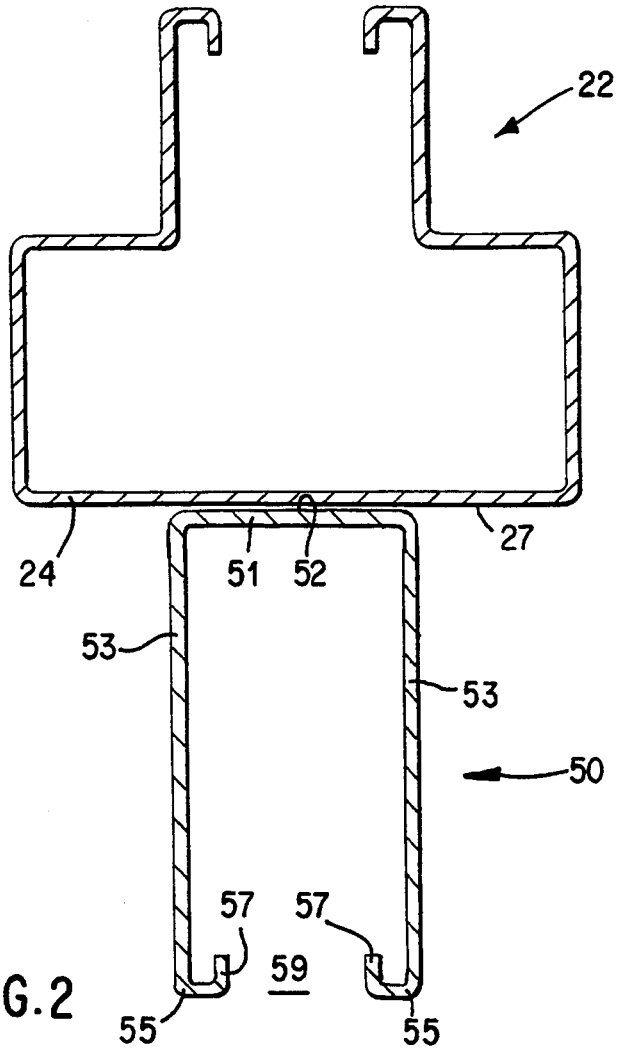
FIG. 2 is a cross-sectional view of a structural framing member, according to another preferred embodiment of this invention.

Referring now to FIG. 2, the basic structural framing member 22 is shown with only certain elements identified in FIG. 2. It is apparent that structural framing member 22 is similar to that shown in FIG. 1 and element reference numerals between both figures remain the same. According to the preferred embodiment of this invention shown in FIG. 2, continuous slot channel member 50 is secured to base 24 of structural framing member 22. Continuous slot channel member 50 comprises channel base 51 with opposing base sides. Two opposing channel side walls 53 each project from corresponding base sides of channel base 51, preferably in a direction approximately perpendicular to channel base 51. Channel side wall 53 comprises upper channel flange 55 directed inward toward an opposite channel side wall 53. Upper channel flange 55 is preferably positioned approximately perpendicular with respect to channel side walls 53. Upper channel flange 55 has a terminal channel end portion 57 which is angled toward channel base 51 and which is positioned approximately perpendicular with respect to upper channel flanges 55. Terminal channel end portions 57 are spaced apart from each other and thereby form continuous channel slot 59 along a longitudinal axis of continuous slot channel member 50.

Bottom channel surface 52 of channel base 51 is secured to and in planar contact with bottom surface 27 of base 24. It is apparent that channel base 51 can be secured either directly to or with respect to base 24 by a welded connection or by any other suitable method known to those skilled in the art.

It is also apparent that although certain dimensional proportions are shown in the drawings, other proportions and specific dimensions of the shape of structural framing member 22, continuous slot channel member 50 and other elements discussed throughout the specification and in the claims can vary, depending upon the particular intended use for and the design of the applicable element. For example, the width of intermediate flange 32 can vary depending upon the bearing surface required, the width of slot 44 can be varied to accommodate different fasteners, the length of side wall 28 can vary depending upon the fastening method used to attach a member to intermediate flange 32, and dimensions A and B can vary also depending upon the particular use of structural framing member 22.

Figure 3:
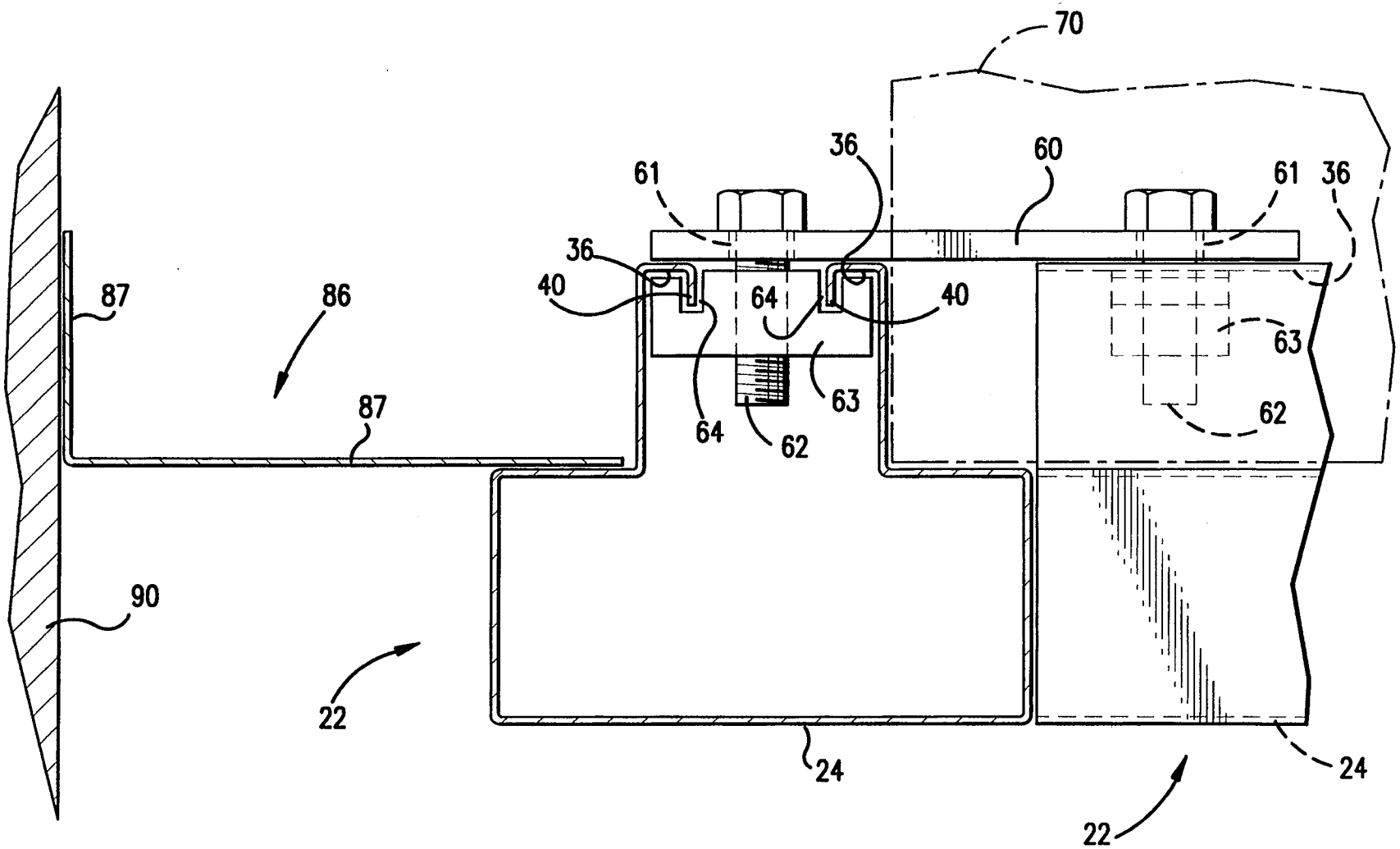
FIG. 3 is a partial cross-sectional view of two perpendicularly positioned structural framing members attached with respect to each other and with respect to a fixed surface, according to one preferred embodiment of this invention.

FIG. 3 shows a structural framing assembly with a connection between two structural framing members which are positioned approximately perpendicular with respect to each other. As shown in FIG. 3, both bases 24 lie in approximately a same plane, within certain tolerances. Splice plate 60 is used to secure both structural framing members with respect to each other. A first portion of splice plate 60 is secured against upper flanges 36 of one structural framing member 22 and another portion of splice plate 60 is secured against upper flanges 36 of another structural framing member 22.

In one preferred embodiment according to this invention, splice plate 60 has two through holes 61, each of which can be aligned with continuous slot 44. A fastener, such as an externally threaded bolt can be positioned within through hole 61 and continuous slot 44 in order to secure splice plate 60 to both structural framing members 22. Each fastener 62 is fixed with respect to the corresponding structural framing member 22. In one preferred embodiment according to this invention, nut 63 which has an internally threaded through hole is used to engage the external threads of fastener 62. Nut 63 preferably has two opposing and parallel grooves 64 which mate with terminal end portions 40 of structural framing member 22. As fastener 62 is tightened within nut 63, terminal end portions 40 are pulled within grooves 64 until nut 63 bottoms out against the end surface of terminal end portion 40. Thus, fastener 62 can be tightened to adequately secure splice plate 60 with respect to structural framing member 22. As shown by the phantom lines in FIG. 3, panel 70 is positioned on one of intermediate flanges 32 of a first structural framing member 22 and also on one of intermediate flanges 32 of a second structural framing member 22. Panel 70 may comprise a deck panel designed to support live and dead loads and also for accommodating equipment or construction workers, a laminated panel, a ceiling panel, a perforated panel, an insulation panel or any other suitable panel or panel-type structure which is supported from fixed structure 90.

Fixed structure 90 can be either an I-beam, a wall structure, a C-channel, or any other suitable structural member which can support the load of panel 60 and all associated elements. As shown in FIG. 3, fixed structure 90 is a vertical wall. Angle bracket 86 is used to complete the panel structure. As shown in FIG. 3, one horizontal leg 87 is attached to intermediate flange 32 and a corresponding vertical leg 87 is secured to fixed structure 90, by any suitable manner known to those skilled in the art.

Figure 4:
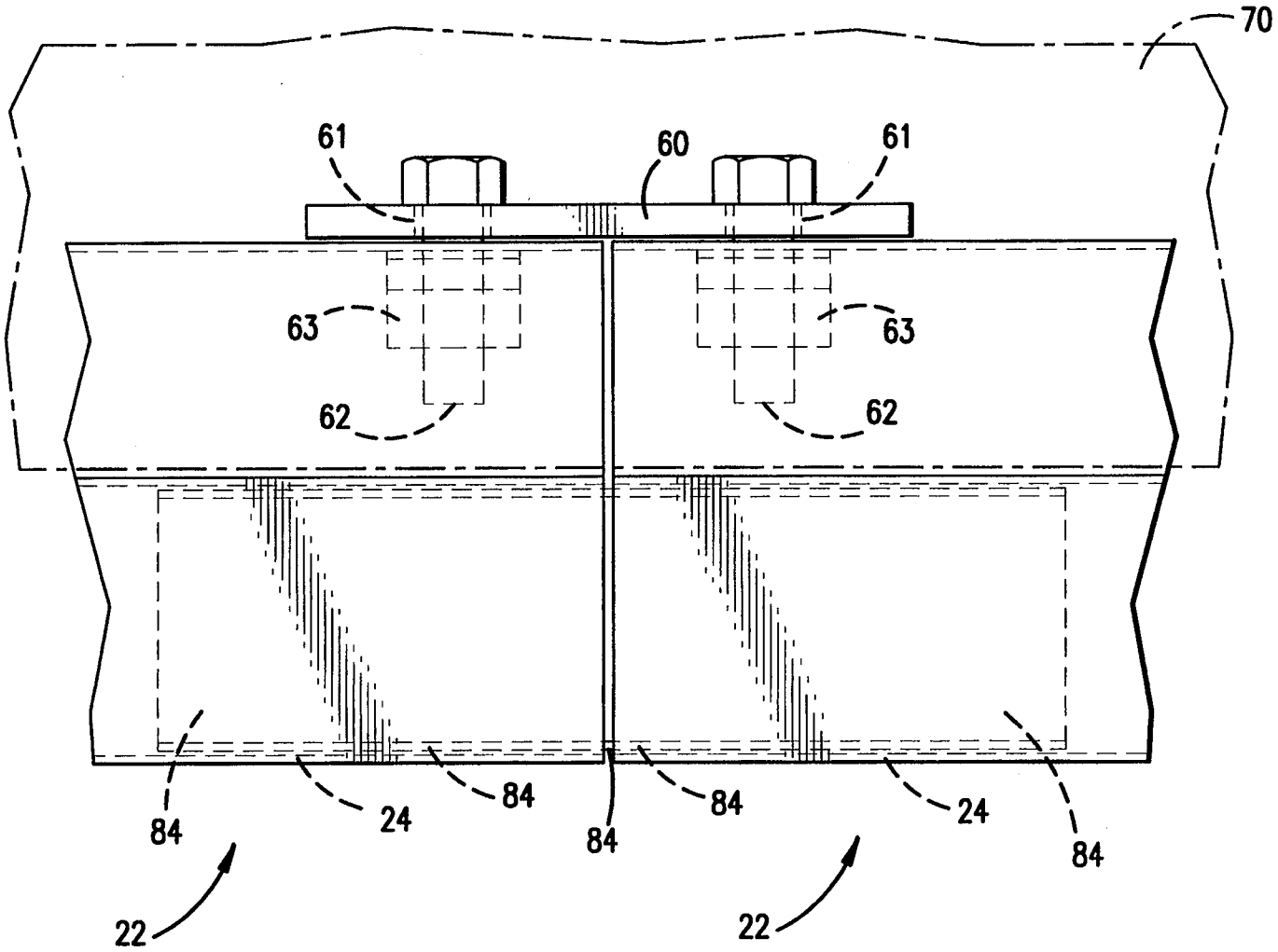
FIG. 4 is a front view of two longitudinally aligned structural framing members attached with respect to each other, according to another preferred embodiment of this invention.

FIG. 4 shows another connection between two longitudinally aligned structural framing members 22, according to one preferred embodiment of this invention. As discussed above with respect to the embodiments shown in FIG. 3, splice plate 60 can be used in a similar fashion for securing both longitudinally positioned structural framing members 22 with respect to each other. The same type of securement means are used to secure one portion of splice plate 60 against upper flanges 36 of one structural framing member 22 and also for securing another portion of splice plate 60 against upper flanges 36 of another structural framing member 22. Both bases 24 again generally lie within a same plane, within given tolerances. Base 24, side walls 28 and intermediate flanges 32 of structural framing member 22 define longitudinal hollow space 30, as shown in FIGS. 1 and 4A, which is in communication with continuous slot 44.

Splice member 84 is positioned within hollow space 30 of both longitudinally aligned structural framing members 22, so that at least a portion of splice member 84 spans both structural framing members 22. Splice member 84 is secured to both structural framing members 22 in any suitable manner known to those skilled in the art, such as a spot weld.

Figure 4A:
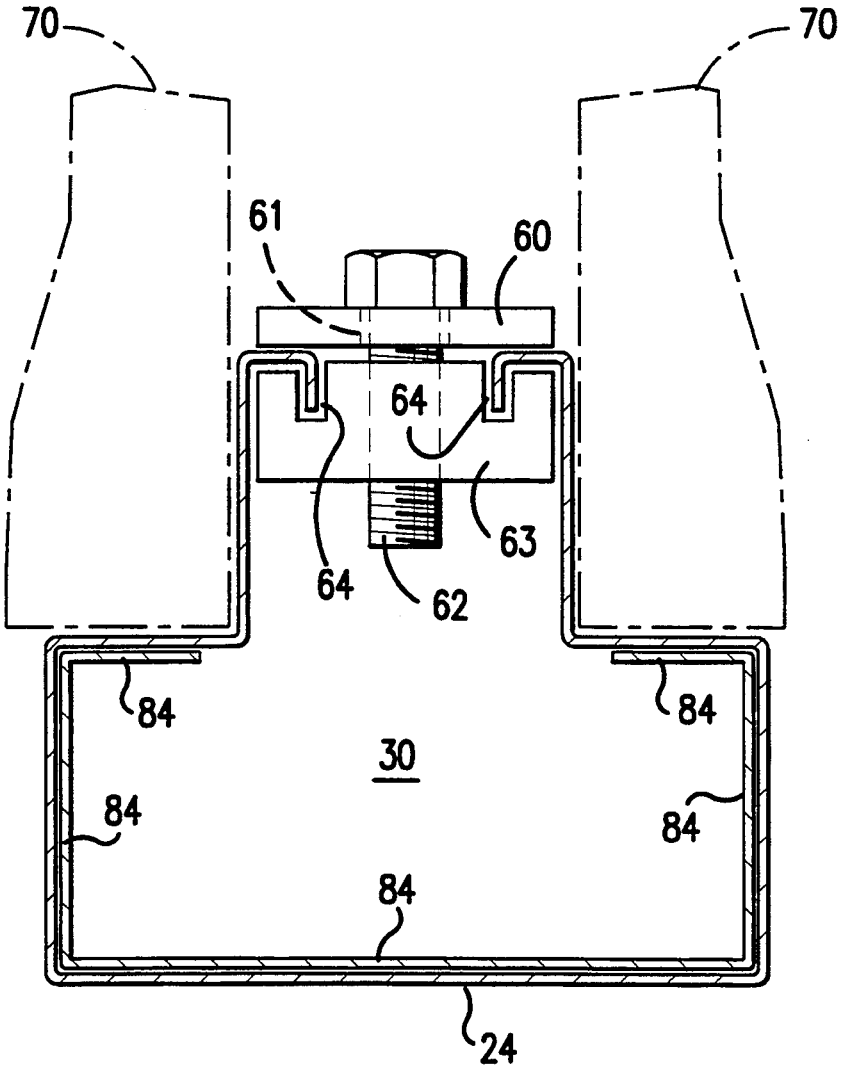
FIG. 4A is a partial cross-sectional view taken along a longitudinal axis of the structural framing member shown in FIG. 4.

According to one preferred embodiment of this invention, splice member 84 comprises a roll formed continuous sheet metal piece that has a shape which conforms to at least a portion of inner wall 26, inner walls 29 and inner walls 33, as shown in FIGS. 1 and 4A. Thus, it is apparent that splice member 84 can have a generally C-shaped cross section, as shown in FIG. 4A, or can have any portion of the shape as shown in FIG. 4A. It is also apparent that splice member 84 can be a solid block or any other suitable rigid member that can span both structural framing members 22 and can be positioned within hollow space 30.

As shown in FIGS. 4 and 4A, the phantom lines again represent panel 70. It is apparent that angle bracket 86, as shown in FIG. 3, can also be used to complete the panel structure when two longitudinally positioned structural framing members 22 are employed.

Figure 5:
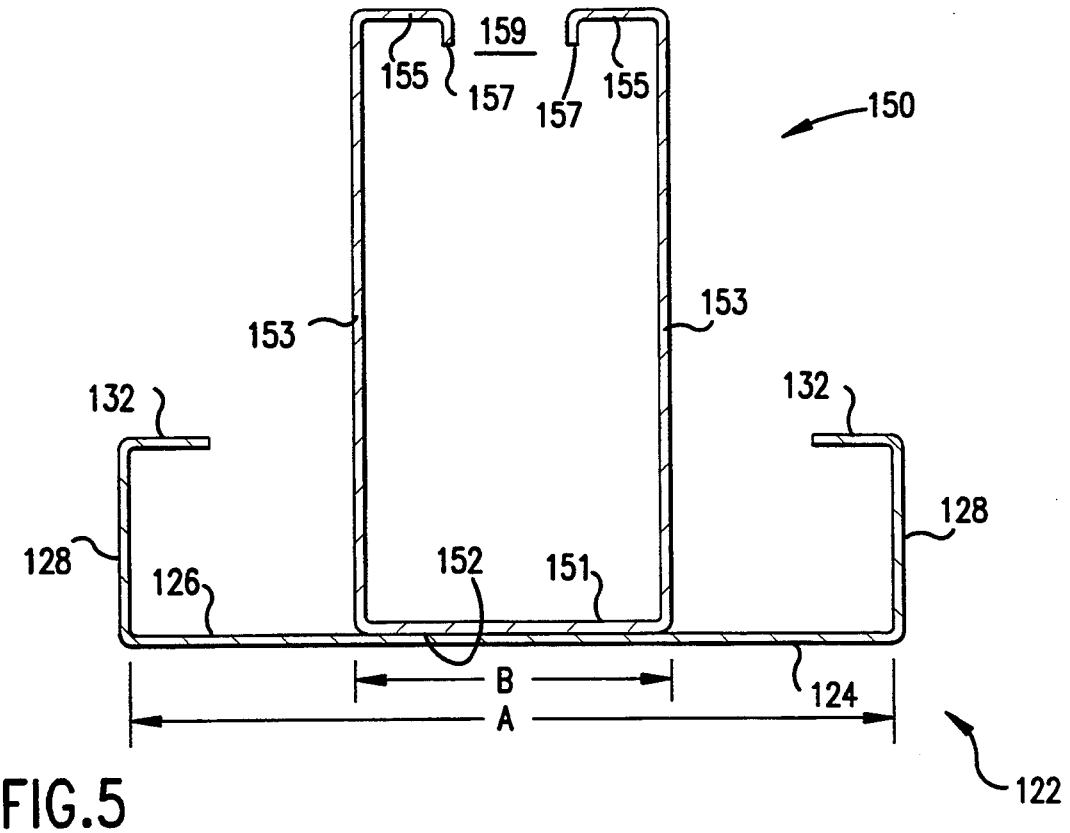
FIGS. 5–9 are cross-sectional views of structural framing members, according to other preferred embodiments of this invention.

FIGS. 5–9 show various preferred embodiments of a two-element structural framing member 122, according to another preferred embodiment of this invention. As shown in FIG. 5, continuous slot channel member 150 is similar to continuous slot channel member 50 as previously described. Continuous slot channel member 150 comprises base 151 and two opposing side walls 153 positioned approximately perpendicular to base 151. End flange portion 155 is positioned approximately perpendicular to side wall 153. Both end flange portions 155 are directed inward toward each other. Each end flange portion 155 has terminal end portion 157 which is directed downward, relative to the direction shown in FIG. 5, toward base 151. Terminal end portions 157 are spaced apart from each other, thereby defining continuous slot 159.

The second element of the two-element structural framing member 122 comprises base 124 having two opposing side walls 128 positioned at an angle, preferably approximately 90°, with respect to base 124. Distance B represents the inner width of base 24 which is preferably less than distance A which represents the outer width of base 124. Bottom surface 152 of base 151 preferably faces top surface 126 of base 124. It is apparent that base 151 can be either secured directly to base 124 or can be fixed with respect to base 124. As shown in FIGS. 5–9, base 151 is secured directly to base 124.

Figure 6:
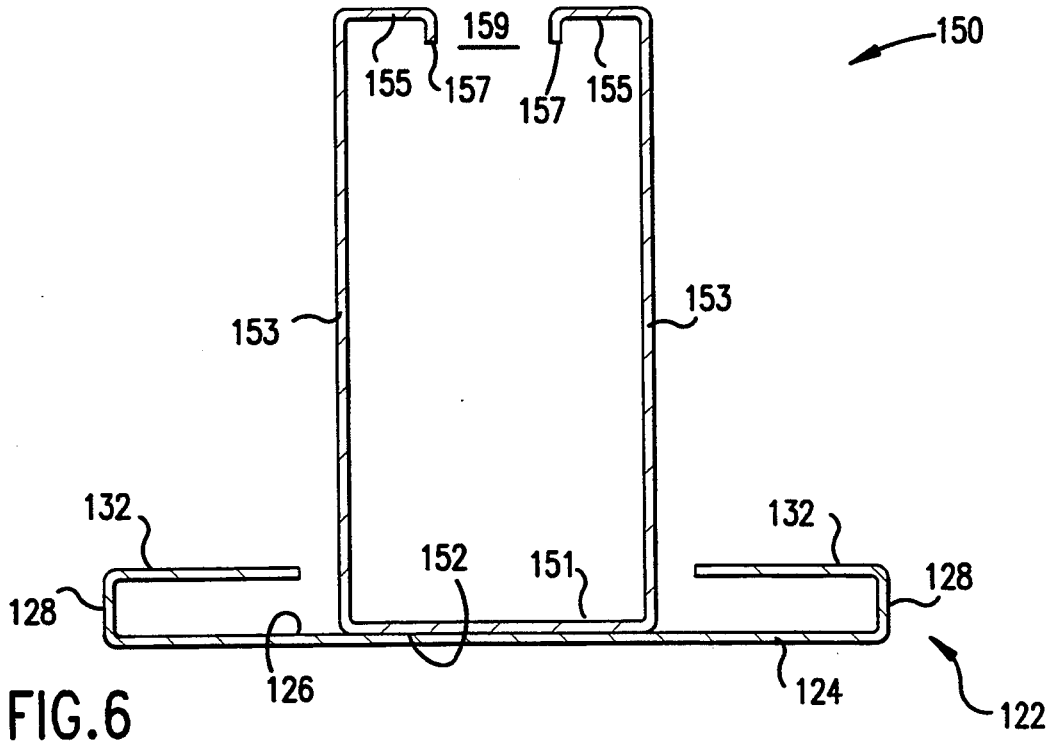
Figure 8:
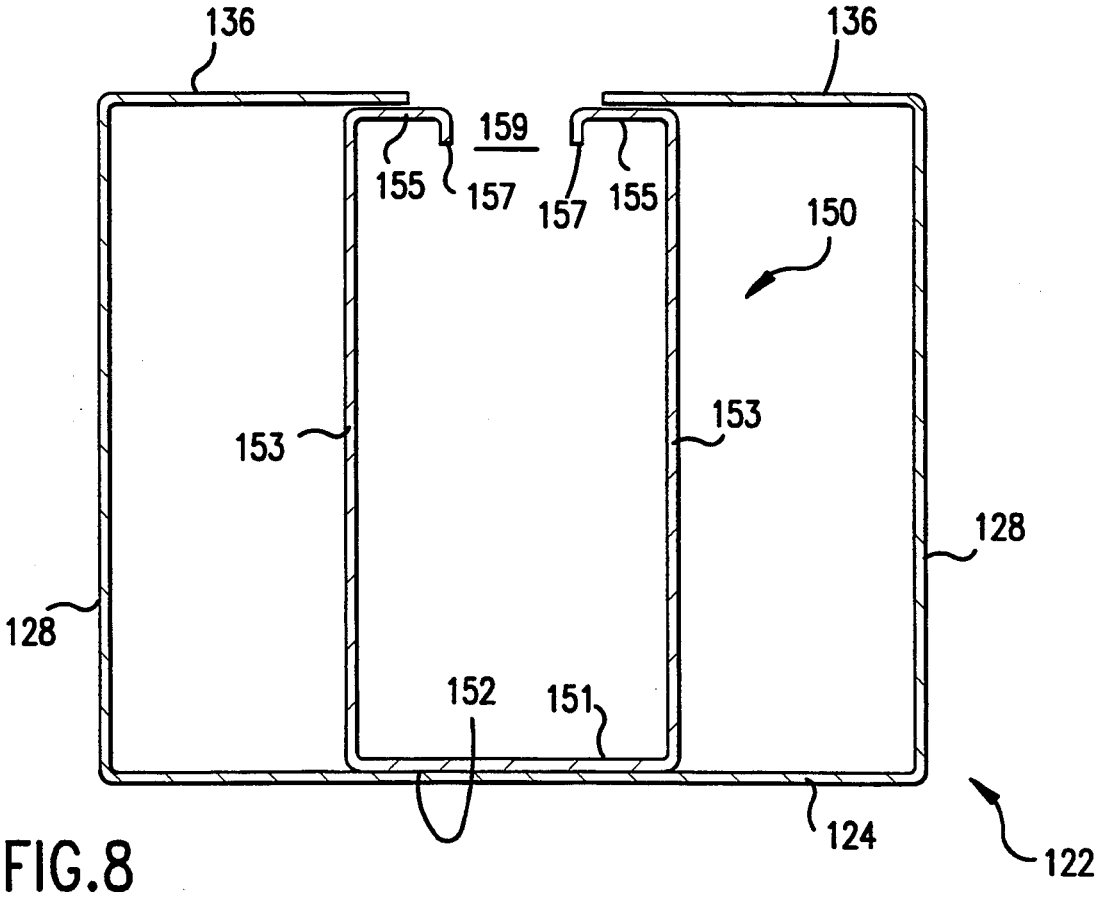

FIG. 6 shows another preferred embodiment of the invention which is similar to the embodiment shown in FIG. 5, except that the distance between intermediate flange 132 and base 124 is significantly reduced. Another preferred embodiment of this invention is shown in FIG. 8, wherein another extreme relative position of intermediate flange 132 with respect to base 124 is shown. According to the preferred embodiment shown in FIG. 8, a bottom surface of intermediate flange 132 abuts or is in planar contact with a corresponding top surface of end flange portion 155. It is apparent that end flange portion 155 can either be attached to intermediate flange 132 or can be secured in any suitable manner known to those skilled in the art.

Figure 7:
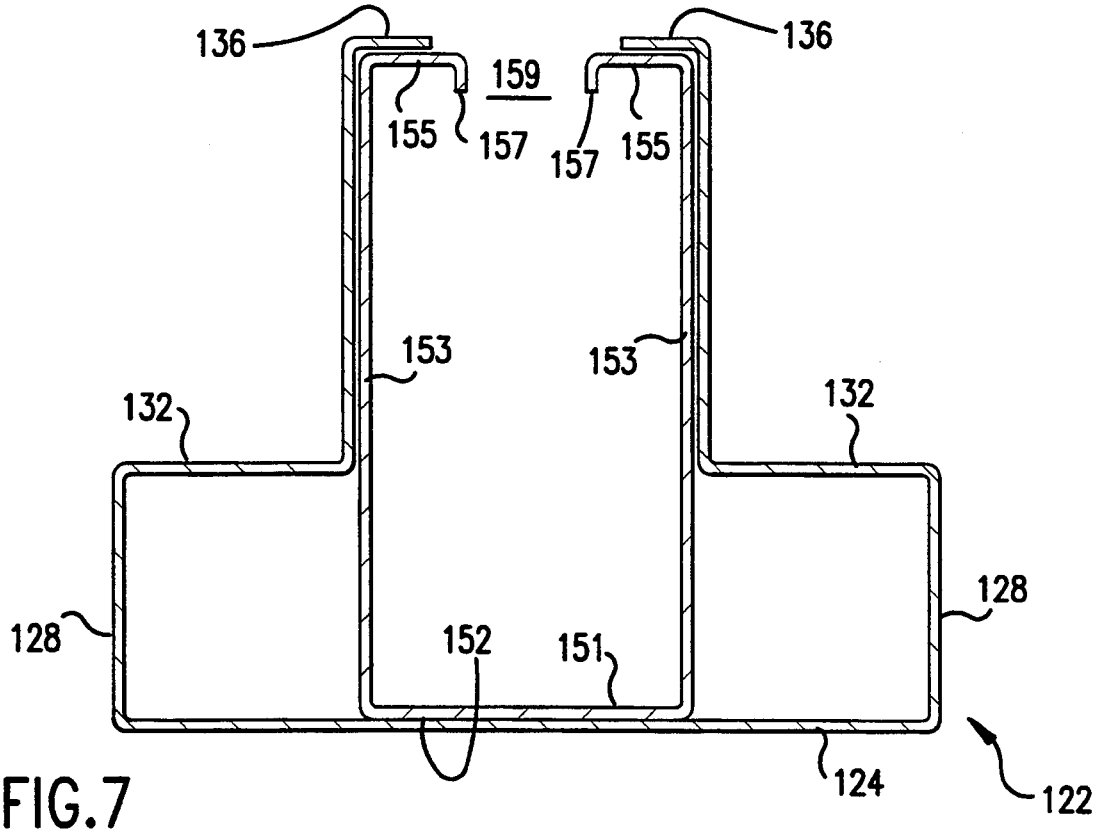

Referring to the preferred embodiment of this invention as shown in FIG. 7, the overall cross-sectional shape of such embodiment is similar to the preferred embodiment as shown in FIG. 1, except that the preferred embodiment shown in FIG. 7 comprises two elongated elements rather than one roll formed continuous piece of sheet metal or other suitable material. As shown in FIG. 7, intermediate flange 132 is formed and linearly offsets a first or lower portion of side wall 128 with respect to a second or upper portion of side wall 128.

Figure 9:
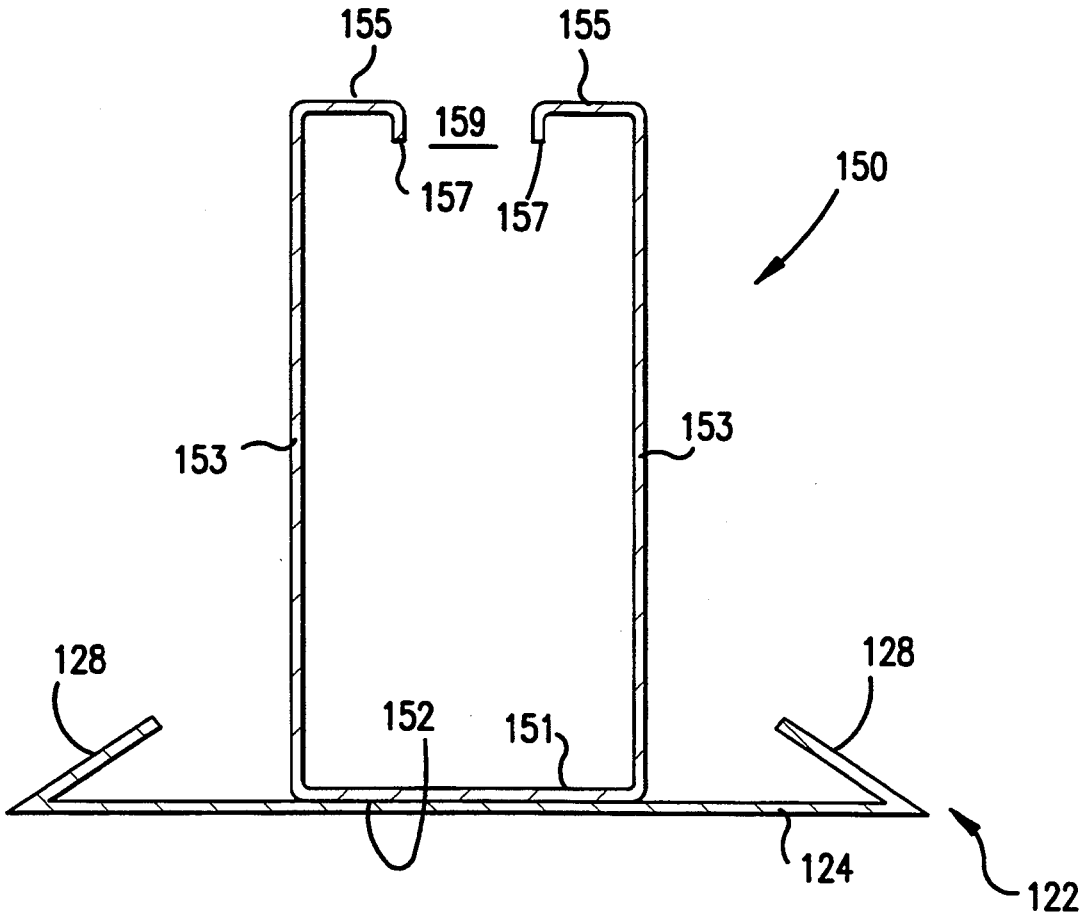

As shown in the preferred embodiment of FIG. 9, side walls 128 are angled inward so that they converge toward each other in a direction away from base 124. Each side wall 128 is at an acute angle with respect to base 124.

Figure 10:
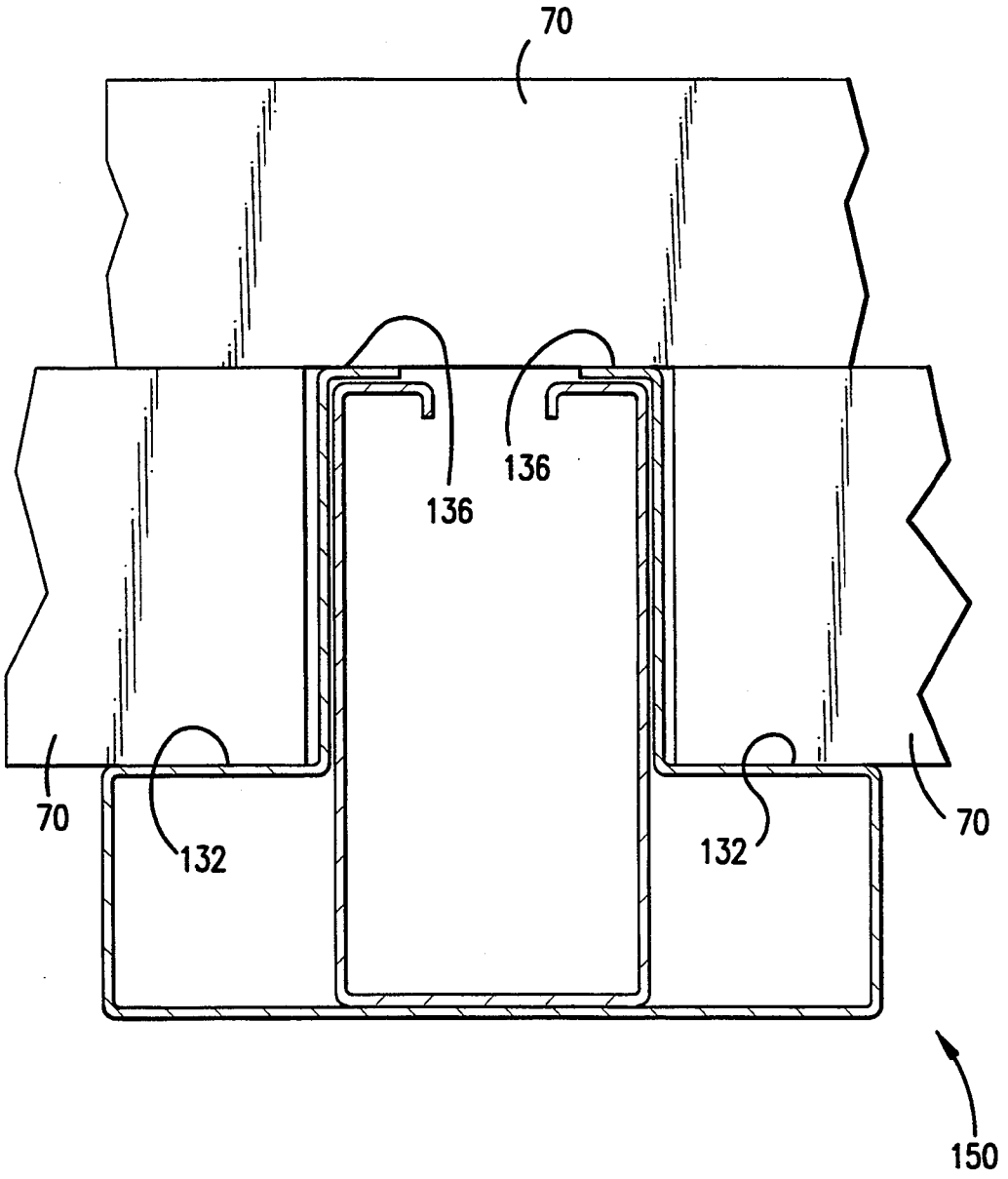
FIG. 10 is a partial cross-sectional view of a structural framing member and two panel layers supported upon intermediate flanges of the structural framing member, according to one preferred embodiment of this invention.
Figure 11:
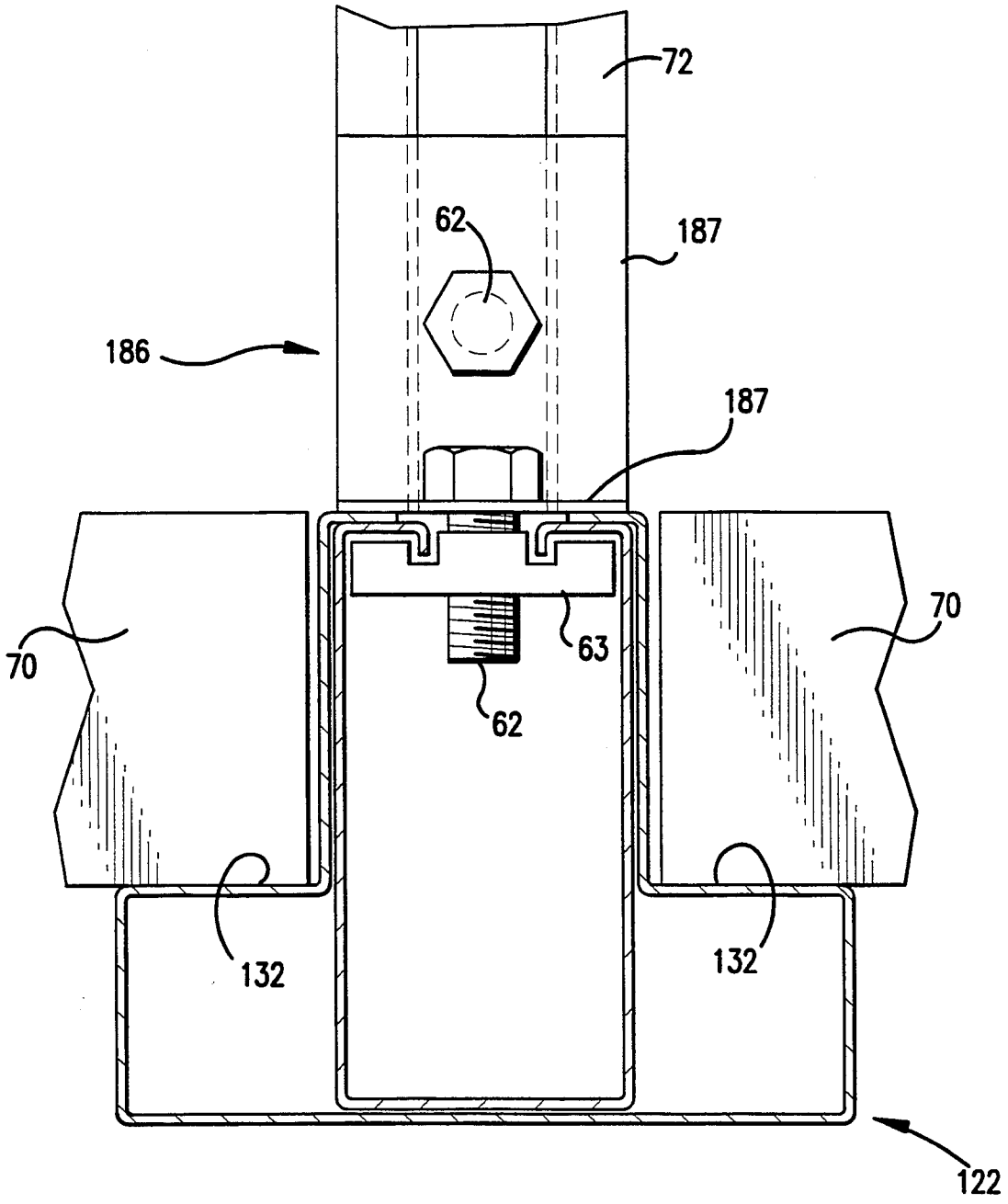
FIG. 11 is a partial cross-sectional view of a continuous slot structural hanging member which is connected and positioned perpendicular to a structural framing member, according to another preferred embodiment of this invention.

FIG. 10 shows a composite panel structure having two panels 70 stacked one on top of the other. The lower panel 70 is supported upon intermediate flange 132. FIG. 11 shows a panel structure comprising structural framing member 122, according to one preferred embodiment of this invention, with hanger 72 secured with respect to structural framing member 122. Angle bracket 186 has one leg 187 fastened to hanger 72 and another leg 187 fastened to structural framing member 122. The upper portion of hanger 72 can be secured or attached to any suitable structural member.

Figure 12:
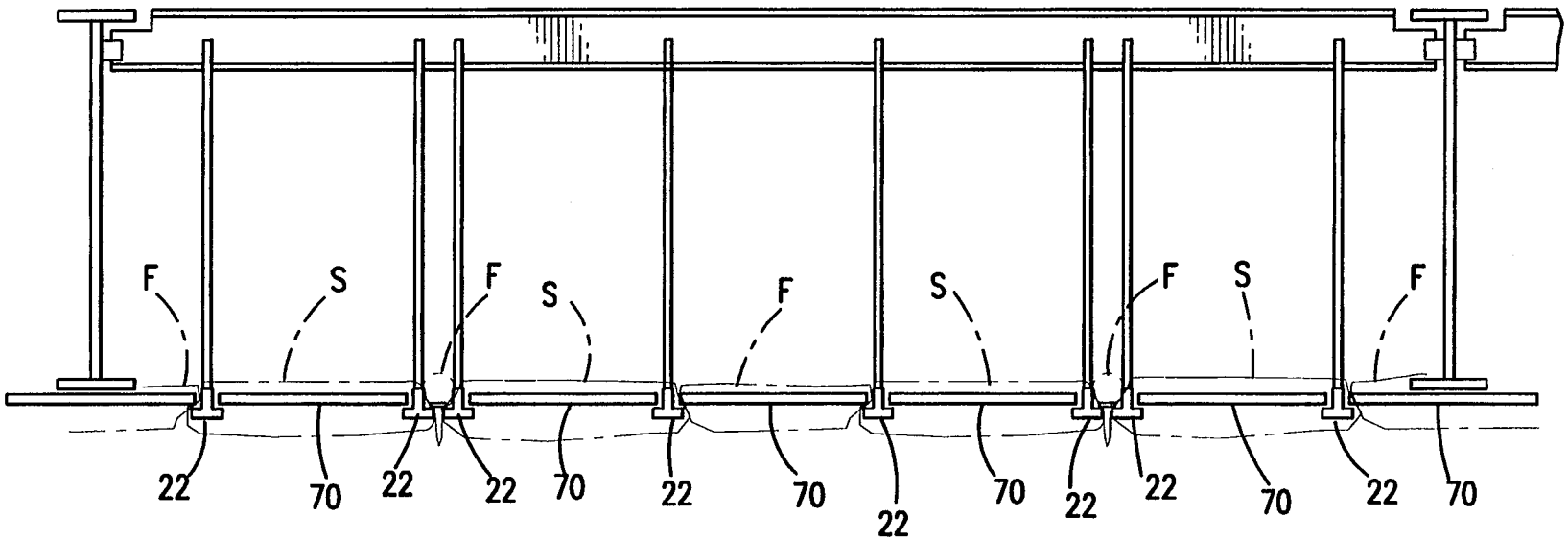
FIG. 12 is a diagrammatic view of a plurality of prefabricated panel structures supported from an I-beam with structural hanging members, according to one preferred embodiment of this invention.

FIG. 12 shows a diagrammatic view of a panel structure using a prefabricated panel structure, according to one preferred embodiment of this invention. The panel structures identified by the phantom lines having element reference numeral S represent the shop panels which are prefabricated at a remote location from the actual installation site, jobsite, or field site. Such prefabricated panel structures are constructed in an environment which is more efficient than at the field site. Such prefabricated panel structures can be assembled and then shipped or transported to a jobsite. When transporting such prefabricated panel structures, other panels and structural components can be loaded or stacked on top of the prefabricated panel structures for convenient shipping or transport.

The elements of FIG. 12 which are circled by the phantom line having element reference numeral F represent work that could occur in the field. The prefabricated panel structures S are installed by attaching structural hanger 72 from a suitable structural element, such as the I-beam shown in FIG. 12. The distance between prefabricated panel structures S can be adjusted in the field depending upon the particular loads that will be subjected to the deck or panel structure. Once the prefabricated panel structures S are installed, the field panel structures F can be erected by placing panel 70 between structural framing members 22 or 122 of the prefabricated panel structures S.

The overall efficiency of the construction installation in the field can be significantly enhanced by importing prefabricated panel structures S to the jobsite. Because such prefabricated panel structures S have such a high degree of adjustability with respect to installation, structural obstructions and other custom-built installations can be easily incorporated into specific designs.

In order to accommodate for varying loads upon the deck or panel structure, each structural hanger 72 may comprise adjustment means for varying the length of structural hanger 72. Thus, in a dead load situation, the centermost structural hanger 72 can be shortened to accommodate for various stresses and deflections in the panel structure. Such adjustment means may comprise an externally threaded rod having one end engaged within an internally threaded hole within a portion of structural hanger 72 and an opposite end of the rod threadedly engaged with an internally threaded hole within another separate portion of structural hanger 72. Such adjustment means may also comprise torquing means for rotating the externally threaded rod with respect to structural hanger 72.

Figure 13:
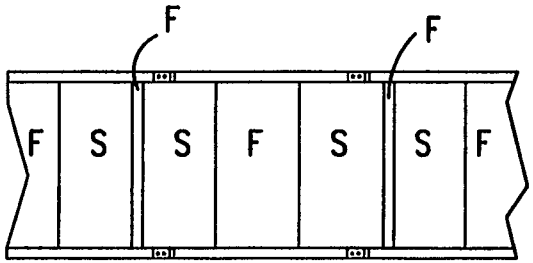
FIG. 13 is a diagrammatic reduced plan view of the plurality of prefabricated panel structures, as shown in FIG. 12.

In one preferred embodiment according to this invention, prefabricated panel structure S comprises two elongated structural framing members 22 or 122 positioned on opposing sides of panel 70, as shown in FIGS. 12 and 13. Structural framing members 22 or 122 are attached to panel 70 on opposing sides of panel 70. Panel 70 is supported upon intermediate flange 32 as previously discussed in the specification. It is apparent that continuous slot 144 or 159 enables field adjustments of structural hanger 72 and of structural framing members 22 or 122 with respect to each other.

Figure 14:
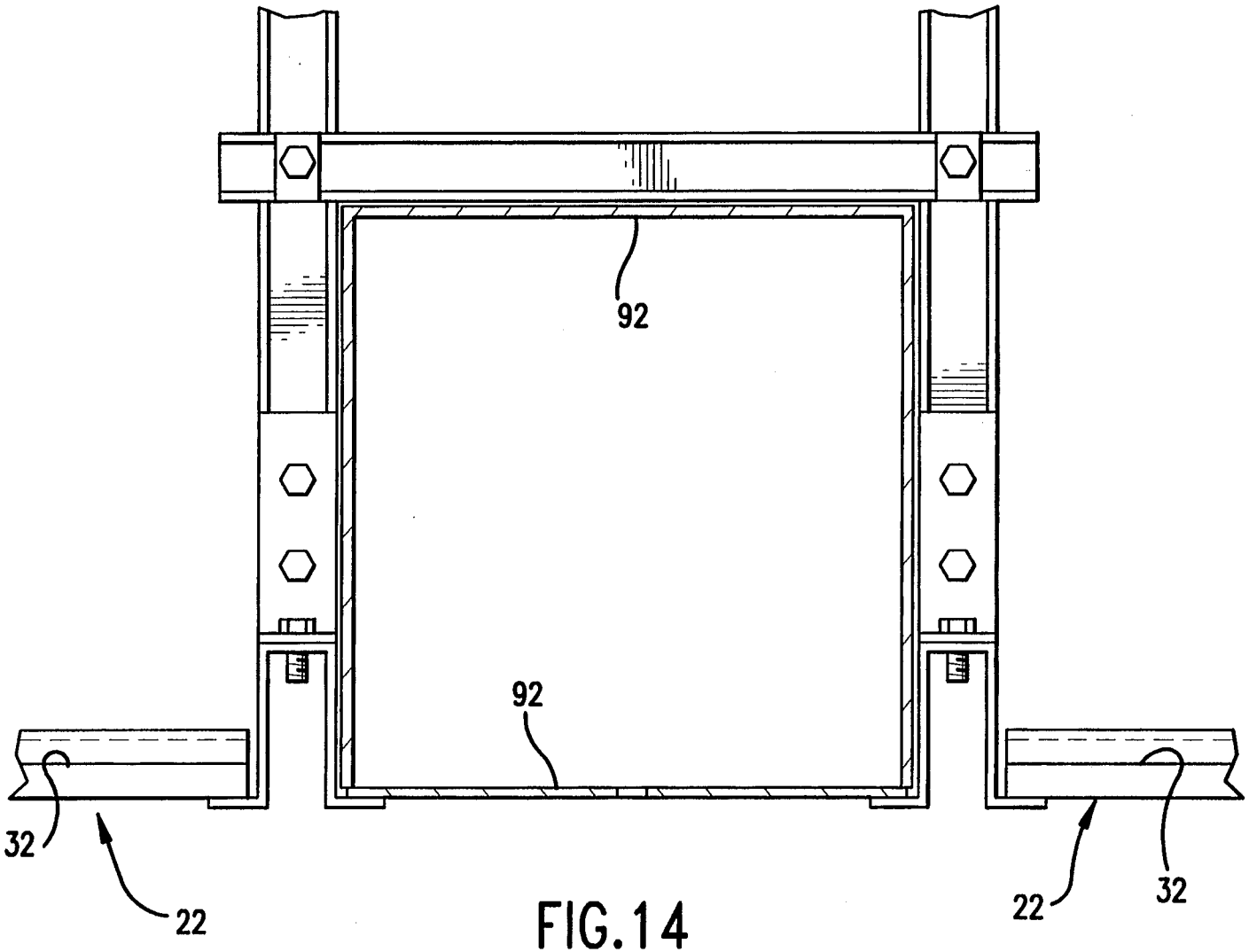
FIG. 14 is a partial cross-sectional view of a transfer duct mounted within a panel structure, according to one preferred embodiment of this invention.

FIG. 14 shows a cross-sectional view of transfer duct 92 which can be incorporated into the panel structure. Transfer duct 92 can be used for transferring gases or can be used to house pipelines or other mechanical or electrical components.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

I claim:

1. A structural framing assembly comprising:

two elongated structural framing members each comprising a base having two opposing sides, two opposing side walls each projecting from corresponding said sides of said base in a direction approximately perpendicular to said base, each said side wall having an intermediate flange approximately parallel to said base, each said intermediate flange dividing each corresponding said side wall into a first side wall portion and a second side wall portion, a first plane defined by said first side wall portion being approximately parallel to a second plane defined by said second side wall portion, a first distance between said first side wall portions being greater than a second distance between said second side wall portions, each said second side wall portion having an upper flange directed toward an opposite said second side wall portion and positioned approximately perpendicular with respect to said side walls, each said upper flange having a terminal end portion angled toward said base and approximately perpendicular to said upper flanges, and said terminal end portions spaced apart from each other forming a continuous slot along a length of the structural framing member, said base and said side walls defining a longitudinal hollow space; and a first of said structural framing members longitudinally aligned with respect to a second of said structural framing members, both said bases positioned within a same approximate plane;

a splice plate, said splice plate having a first through hole and a second through hole, a first fastener extending through said first through hole and within said continuous slot of said first structural framing member, a second fastener extending through said second through hole and within said continuous slot of said second structural framing member, securement means for fixing said first fastener with respect to said first structural framing member and for fixing said second fastener fixed with respect to said second structural framing member; and a splice member positioned within said longitudinal hollow space of said first structural framing member and within said hollow space of said second structural framing member, said splice member spanning at least a portion of both said structural framing members, and said splice member secured to said first structural framing member and secured to said second structural framing member.

2. A structural framing assembly according to claim 1 wherein said splice member is a plate.

3. A structural framing assembly according to claim 1 wherein said securement means further comprise: a first nut having a first internally threaded through hole engagingly mateable with said first fastener, said first nut having two opposingly parallel first grooves mateable with said terminal end portions of said first structural framing member, a second nut having a second internally threaded through hole engagingly mateable with said second fastener, said second nut having two opposingly parallel first grooves mateable with said terminal end portions of said second structural framing member, said first nut positioned within said continuous slot of said first structural framing member, and said second nut positioned within said continuous slot of said second structural framing member.

4. A structural framing assembly according to claim 1 further comprising: a panel supported upon said intermediate flange of said first structural framing member and an aligned said intermediate flange of said second structural framing member.

5. A structural framing assembly according to claim 1 further comprising a closure plate having one plate end portion secured to an upper surface of one of said intermediate flanges and an opposite plate end portion secured to a fixed structure.

6. A structural framing assembly according to claim 1 wherein said splice member further comprises a roll formed continuous sheet metal member that conforms to at least a portion of base inner walls of said base, side inner walls of said side walls and flange inner walls of said intermediate flanges.

7. A structural framing assembly according to claim 6 wherein said splice member has a C-shaped cross section.

* * * * *